United States Patent [19]

Bardoni et al.

[11] 4,028,778

[45] June 14, 1977

[54] UNDERWATER BELT AND HOSE CLIP

[76] Inventors: Thomas J. Bardoni, 459 Poplar, Wyandotte, Mich. 48192; William Markarian, 5970 Weddel, Taylor, Mich. 48180

[22] Filed: July 7, 1975

[21] Appl. No.: 593,719

[52] U.S. Cl. ..... 24/79; 24/73 SF

[51] Int. Cl.[2] ..... A44B 11/00; A44B 21/00

[58] Field of Search ..... 24/73 LF, 73 BG, 73 BH, 24/73 SF, 76, 79, 74 A, 3 A, 259 A, 5, 73 AP, 252 SH, 259 SH, 255 HC; 128/142.3; 2/2.1 R, 428, 429, 430

[56] References Cited

UNITED STATES PATENTS

| | | | |
|---|---|---|---|
| 344,555 | 6/1886 | Wood | 24/259 SH |
| 354,658 | 12/1886 | Runge et al. | 128/142.3 |
| 958,249 | 5/1910 | Hirsh | 24/73 SF |
| 978,821 | 12/1910 | Brown et al. | 24/73 LF |
| 1,507,215 | 9/1924 | Spettigue | 24/73 LF |
| 2,337,782 | 12/1943 | Taffae | 24/5 |
| 2,449,882 | 9/1948 | Daniels | 24/3 A X |
| 3,135,098 | 6/1964 | Root | 2/2.1 R |
| 3,307,540 | 3/1967 | Link | 2/2.1 R |
| 3,516,631 | 6/1970 | Santucci | 24/73 AP X |

*Primary Examiner*—Robert L. Wolfe
*Attorney, Agent, or Firm*—Basile, Weintraub & VanOphem

[57] ABSTRACT

A belt and hose clip for use in underwater activity such as swimming and diving includes a base plate having a belt receiving slot and a flexible hose retaining member integrally formed with the base plate.

7 Claims, 4 Drawing Figures

UNDERWATER BELT AND HOSE CLIP

BACKGROUND OF THE INVENTION

1. Field of the Invention

The present invention pertains to clips. More particularly, the present invention pertains to clips for retaining hosing on belting. Even more particularly, the present invention pertains to clips for use in securing hosing to belting during underwater activity.

2. Prior Art

As is known to those skilled in the art to which the invention pertains, underwater diving equipment is cumbersome and difficult to manage when in use. Furthermore, oftentimes the entanglement of hoses and belts create serious hazards to the user. This is especially true when the breathing hoses associated with diving tanks slip out of the mouth of the user. Ordinarily, a diver has at least two hoses extending to a central mouthpiece, with one hose on each side of the neck. If the mouthpiece slips out and draws back against the throat of the user, this could be deadly. Less dangerous, but still annoying, is the attempted recapturing of a single breathing hose when it slips out of the user's mouth.

Applicants are unaware of any presently known means for alleviating the situation outlined above. Thus, a major advance in the art would be provided by a means by which the hoses could be removed from a user's mouth without the attendant hazards and annoyances and which does not add any further bulk to the user.

SUMMARY OF THE INVENTION

In accordance with the present invention there is provided a lightweight clip for retaining hosing on belting. The clip hereof is particularly adapted for use by underwater divers.

The clip generally comprises a base plate having belt receiving slots formed therethrough. The clip also includes hose retaining means integrally formed with the base plate. The retaining means comprises a U-shaped member which resiliently holds the hosing between the member and the base plate.

For a more complete understanding of the present invention reference is made to the following detailed description and accompanying drawing. In the drawing like reference characters refer to like parts throughout the several views in which:

DESCRIPTION OF THE PREFERRED EMBODIMENTS

Figure 2:
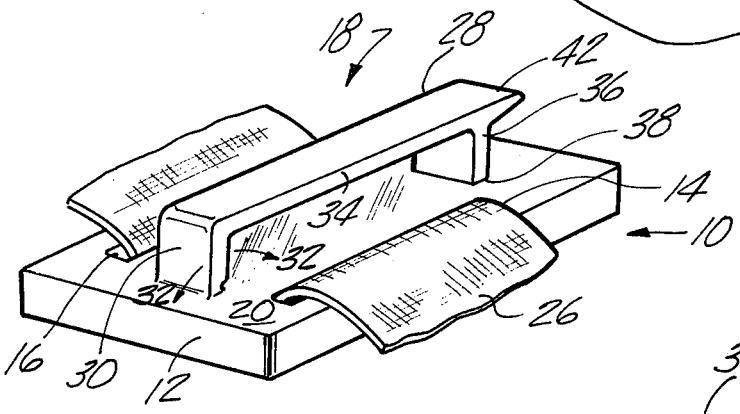
FIG. 2 is a perspective view of the clip of the present invention.
Figure 3:
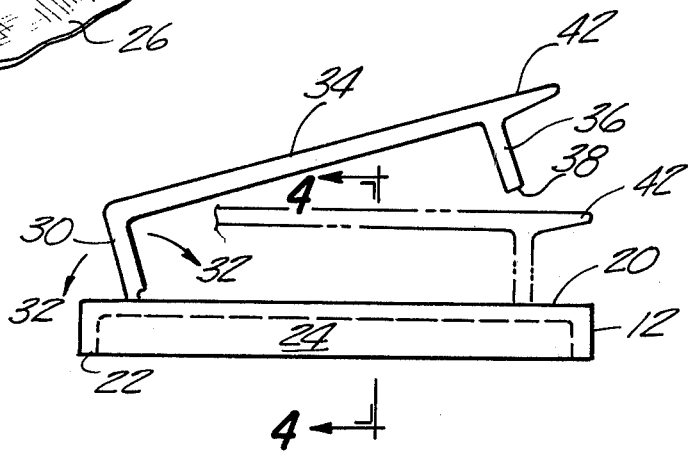
FIG. 3 is a side elevational view of the clip of the present invention.
Figure 4:
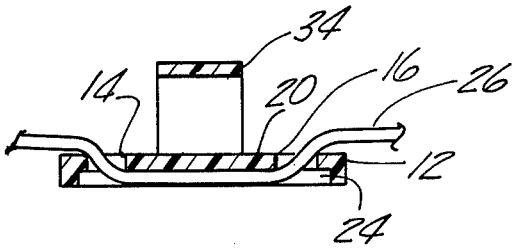
FIG. 4 is a cross-sectional view taken along the line 4—4 of FIG. 3.

Now with reference to the drawing and in particular FIGS. 2–4, there is depicted therein a clip, generally indicated at 10, as contemplated by the present invention. The clip or device 10 hereof comprises a base 12. The base or base plate 12 has a pair of slots 14, 16 formed therethrough. The slots 14, 16 cooperate to define belt or belting receiving means, in a manner to be defined hereinafter. The device 10 hereof further includes hose retaining means, generally, denoted at 18.

With more particularity, the present clip 10 comprises an integrally formed base 12 having an upper surface 20 and a lower surface 22. A recessed area 24 is formed in the lower 22. The recessed area has a width substantially equal to that of the width of the spaced apart, parallel slots 14, 16. Further, the recessed area extends between the slots 14, 16. The recessed area 24 has a depth sufficient to accommodate the thickness of an oxygen tank belt 26 or the belting. By so dimensioning the recess the clip 10 sits flush against a skin diving suit without any bulges created by belting or the like.

As shown in FIGS. 2 and 4, the slots 14, 16 are spaced apart and substantially parallel to each other. One slot is formed on one side of the means 18 and the other on the other side of the means 18. Each slot has a width sufficient to receive the belting 26 therethrough.

The present clip 10, as hereinbefore noted, also includes hose retaining means 18. The hose retaining means 18 comprises a U-shaped member 28 having a first upstanding leg 30 secured to or otherwise hingedly fixed to the upper surface 20 of the base 12. The leg 30 is hingedly secured to the base such that it is limitedly rotatable in the directions of the arrow 32. A cross-leg 34 is integrally formed with the leg 30. The cross-leg 34 is spaced apart from and extends across the base 12 substantially parallel thereto.

A leg 36 downwardly depends from the free end of leg 34, as shown. The leg 36 has a free end 38 which is biassed towards the upper surface 20 of the base 12, but is not secured thereto.

By virtue of the construction of the retaining means 18, the leg 36 can be rotated away from the base 12. This permits a plurality of hoses 40, (FIG. 1), such as those from a breathing unit 44 to be securely retained in the area bounded by the interior surfaces of the legs of the U-shaped member and the upper surface of the base.

In order to facilitate rotation of the member 28 a grasping means, such as a nub 42, is integrally formed with the member at the junction of legs 34 and 36.

In a preferred form of the invention the base and the retaining means are integrally formed from a synthetic resin, such as an ABS plastic. By so forming the clip, the retaining means can be provided with sufficient flexibility to permit the limited rotation necessary, while still imparting sufficient bias to the leg 36 to securely retain the hoses.

Also, although not preferred, the leg 30 could be hinged, such as by a pin, to the base and by providing sufficient weight or other means to the leg 36, the biassing could still be realized.

Figure 1:
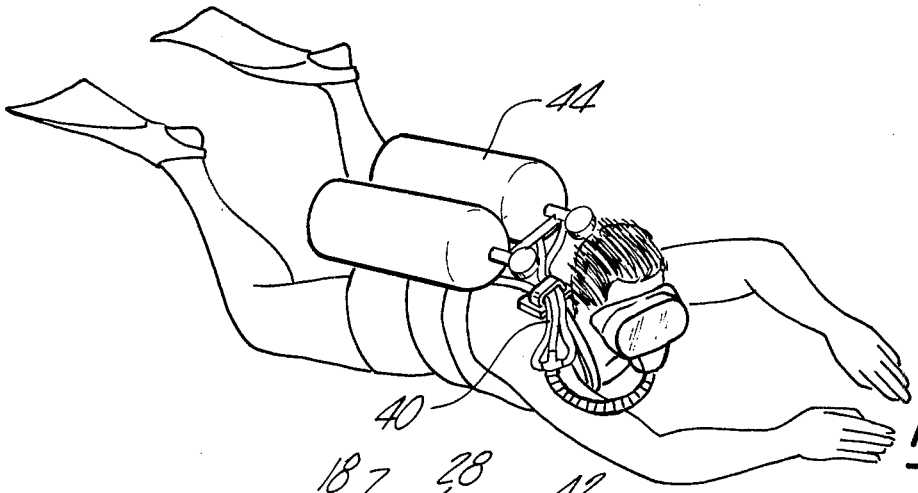
FIG. 1 is a perspective view showing deployment of the clip hereof.

Referring specifically to FIG. 1 there is depicted therein the use of the present clip 10. The clip is deployed by inserting the belting from breathing unit 44 through one of the slots and withdrawing it through the other. The hoses from the breathing tank 44 are then inserted through the hose retaining means 18.

It is to be appreciated that by the use of the present clip, if the breathing hose slips out of the mouth of the user, then it can easily be recaptured because of the minimum range it can slip away.

It is apparent from the preceding that there has been described a clip which is extremely beneficial to underwater devices and which obviates many hazards encountered by the divers.

Having, thus, described the invention what is claimed is:

1. In an underwater swimming apparatus of the type having an oxygen tank, a hose leading from the tank to a central mouthpiece and a belt extending from the tank and being secured about the body of an underwater swimmer, a clip for retaining the belt and the hose, comprising:

a. a base having an upper surface and a lower surface, a recess being formed in the lower surface of the base, b. means for receiving the belt formed in the base such that the belt extends through the clip and sets flush against the body of the user, the portion of the belt disposed beneath the base being nested in the recess, c. means for retaining the hose disposed on the base and comprising a U-shaped member having one leg rotatably secured to the base, and wherein the clip prevents the hose from drawing back against the throat of the user.

2. The clip of claim 1 wherein:

the means for receiving the belt comprises a pair of spaced apart slots formed through the base, the belt being extended through the slots such that the leading edge thereof enters through a first slot and travels beneath the base and exits upwardly through the second slot.

3. The clip of claim 1 wherein the leg opposite the rotatably secured leg is biassed towards the base.

4. The clip of claim 1 which further comprises: means for grasping the U-shaped member.

5. The clip of claim 1 wherein:

a. the means for receiving the belt comprises a pair of spaced apart slots formed through the base, the belt being extended through the slots such that the leading edge thereof enters through a first slot and travels beneath the base and exits upwardly through the second slot, and b. the means for retaining the hose comprises a U-shaped member having one leg rotatably secured to the base, the leg opposite the rotatably secured leg being biassed towards the base.

6. The clip of claim 5 wherein the base has an upper surface and a lower surface, the means for retaining the hose being disposed on the upper surface, and the base has a recess formed in the lower surface, the slots opening into the recess such that the belt nests in the recess when extended through the slots.

7. The clip of claim 6 which further comprises: means for grasping the U-shaped member.

* * * * *